United States Patent [19]

Isozumi

[11] Patent Number: 5,067,357

[45] Date of Patent: Nov. 26, 1991

[54] COAXIAL TYPE STARTER DEVICE

[75] Inventor: Shuzou Isozumi, Himeji, Japan

[73] Assignee: Mitsubishi Denki K.K., Tokyo, Japan

[21] Appl. No.: 554,650

[22] Filed: Jul. 19, 1990

[30] Foreign Application Priority Data

Aug. 19, 1989 [JP] Japan ..... 1-213687

[51] Int. Cl.[5] ..... F02N 11/00

[52] U.S. Cl. ..... 74/7 E; 74/468; 290/38 C; 464/16

[58] Field of Search ..... 74/7 R, 7 E, 468; 290/38 C, 48; 403/359; 464/16

[56] References Cited

U.S. PATENT DOCUMENTS

| | | | |
|---|---|---|---|
| 659,522 | 10/1900 | Furbish | 403/359 X |
| 1,751,634 | 3/1930 | Holmes | 74/468 |
| 2,223,212 | 11/1940 | Jacobsen | 403/359 X |
| 2,281,914 | 5/1942 | Brooks | 74/468 |
| 4,760,274 | 7/1988 | Isozumi | 290/48 |
| 4,800,766 | 1/1989 | Isozumi et al. | 74/7 |
| 4,862,027 | 8/1989 | Isozumi et al. | 74/7 E X |
| 4,941,366 | 7/1990 | Isozumi | 74/7 R X |
| 4,987,786 | 1/1991 | Morishita et al. | 74/7 E X |

FOREIGN PATENT DOCUMENTS

| | | | |
|---|---|---|---|
| 739204 | 6/1932 | France | 74/468 |
| 1311876 | 9/1961 | France . | |
| 229106 | 11/1969 | U.S.S.R. | 74/468 |
| 375231 | 7/1932 | United Kingdom | 403/359 |

*Primary Examiner*—Leslie A. Braun
*Assistant Examiner*—Ryan W. Massey
*Attorney, Agent, or Firm*—Sughrue, Mion, Zinn Macpeak & Seas

[57] ABSTRACT

A coaxial type starter device comprises an overrunning clutch device having a clutch inner member and a pinion shaft with a pinion at an end, the pinion shaft being inserted in the clutch inner member so as to be engageble therewith by helical splines formed at the pinion shaft and the clutch inner member so that a torque is transmitted from the clutch inner member to the pinion shaft and a radial load by the pinion shaft is borne by the helical spline of the clutch inner member, wherein the helical splines of the clutch inner member and the pinion shaft have radially contacting portions wherein the outer surfaces of the teeth of the helical spline of the clutch inner member are in slide-contact with the corresponding parts of the helical spline of the pinion shaft, and have radially non-contacting portions wherein the other portions of the helical spline of the clutch inner member face, with gaps, the corresponding parts of the helical spline of the pinion shaft, and wherein the total surface area of the radially contacting portions is larger than that of the radially non-contacting portions.

3 Claims, 3 Drawing Sheets

COAXIAL TYPE STARTER DEVICE

BACKGROUND OF THE INVENTION

1. Field of the Invention

The present invention relates to a coaxial type starter device. More particularly, it relates to an improvement of an overrunning clutch device and a pinion shaft in a coaxial type starter device used for starting an internal combustion engine.

2. Discussion of Background

There has been known a coaxial type starter device provided with a pinion shaft, i.e., a rotary output shaft which is rotated and is movable in its axial direction when it receives a driving force by a motor, disclosed in, for instance, Japanese Unexamined Patent Publication No. 266167/1988.

The coaxial type starter device 1 has a pinion shaft 2 adapted to be rotated and movable in its axial direction wherein a pinion 3 is fixed to the outer circumference of the front end of the pinion shaft 2 by means of a straight spline 4 so as to be engaged with and disengaged from a ring gear attached to the internal combustion engine, as shown in FIG. 4. The pinion shaft 2 passes through the central opening of a clutch inner member 5*a*, which is an element of an overrunning clutch device 5, and is inserted from its front end in a hollow armature rotary shaft 6*a*, which is an element of a d.c. motor 6, the pinion shaft having the rear part which is in contact with a pushing rod 8 extending from an electromagnetic switch device 7 interposing a steel ball 9.

A helical spline 2*a* is formed on the circumference of the pinion shaft 2 placed in the clutch inner member 5*a* of the overrunning clutch device 5. On the other hand, a helical spline 5*b* having a length shorter than that of the helical spline 2*a* is formed in the inner circumference of the front end portion of the clutch inner member 5*a* so as to be engaged with the helical spline 2*a*. The rear end portion of the pinion shaft 2 inserted in the hollow armature rotary shaft 6*a* is supported by a sleeve bearing 10 fitted in the armature rotary shaft 6*a* in a slidable manner.

In the above-mentioned coaxial type starter device 1, when the electromagnetic switch device 7 is actuated, the pinion shaft 2 is pushed forwardly by means of the pushing rod 8, and the pinion 3 is meshed with the ring gear (not shown) of the engine, and at the same time, the d.c. motor 6 is actuated. Then, the revolution of the armature rotary shaft 6*a* is decelerated by means of a planet gear type speed reducing device 11, and the rotating force of the armature rotary shaft 6*a* is transmitted to a clutch outer member 5*c* of the overrunning clutch device 5. Further, the rotating force of the clutch outer member 5*c* is transmitted to the clutch inner member 5*a* through a roller 5*d*. The revolution of the clutch inner member 5*a* is transmitted to the pinion shaft 2 through the helical spline 5*b*, whereby the pinion 3 is rotated. The helical splines 5*b*, 2*a* of the clutch inner member 5*a* and the pinion shaft 2 cooperate to move the pinion shaft 2 in the axial direction to thereby move the pinion 3. They function to transmit a torque produced in the d.c. motor 6 to the pinion shaft 2. Further, they bear a bending force to the pinion shaft, i.e., a radial load which is a component of a force applied to the surfaces of the teeth of the helical splines in the axial direction, said bending force resulting when the pinion 3 is connected to the ring gear. Namely, the helical spline 5*b* of the clutch inner member 5*a* and the helical spline 2*a* of the pinion shaft 2 have a relation as shown in FIG. 5. Specifically, the outer surfaces of the teeth of the helical spline 2*a* are in contact with the bottom surfaces of the grooves of the helical spline 5*b* of the clutch inner member 5*a*, while there is no contact in the other portions. Accordingly, the radial load to the pinion shaft 2 is born by the helical spline 5*b* of the clutch inner member 5*a* at the front part, and is born by the sleeve bearing 10 fitted to the armature rotary shaft 6*a* at the rear part.

As described above, the conventional coaxial type starter device 1 was so designed that the outer surfaces of the teeth of the helical spline 2*a* are in contact with the bottom surfaces of the grooves of the teeth of the helical spline 5*b* so that the radial load to the pinion shaft 2 was born by the helical spline 5*b* of the clutch inner member 5*a* at the front part. However, the helical spline 2*a* is generally formed so that the width of the upper surfaces of the teeth are substantially equal to the width of the bottom surfaces of the grooves, and the helical spline is of a helical gear type having equal pitches. Further, since the electromagnetic switch is provided at the rear of the motor in the coaxial type starter device, the length of the helical spline to be formed in the pinion shaft is small because the entire length of the starter device should be as small as possible. Accordingly, the length of the helical spline 5*b* of the clutch inner member is also small. Accordingly, the surface area in the radial direction of the helical splines 2*a*, 5*b* of the pinion shaft 2 and the clutch inner member 5*a* are small. As a result, the surface pressure becomes large whereby fretting and a shortage of grease often resulted, and a faulty sliding operation occurred in the pinion shaft 2.

SUMMARY OF THE INVENTION

It is an object of the present invention to provide a coaxial type starter device capable of transmitting a torque and bearing a radial load by a helical spline formed in the pinion shaft and a helical spline formed in the clutch inner member while the pinion shaft can be moved smoothly.

The foregoing and other objects of the present invention have been attained by providing a coaxial type starter device which comprises an overrunning clutch device having a clutch inner member and a pinion shaft with a pinion at an end, the pinion shaft being inserted in the clutch inner member so as to be engageable therewith by means of helical splines formed at the pinion shaft and the clutch inner member so that a torque is transmitted from the clutch inner member to the pinion shaft and a radial load by the pinion shaft is borne by the helical spline of the clutch inner member, wherein the helical splines of the clutch inner member and the pinion shaft have radially contacting portions wherein either the outer surfaces of the teeth of the helical spline of the clutch inner member or the bottom surfaces of the teeth of the pinion shaft are in slide-contact with the corresponding parts of the helical spline of the pinion shaft or the clutch inner member, and have radially non-contacting portions wherein the other portions of the helical spline of the clutch inner member or the pinion shaft face, with gaps, the corresponding parts of the helical spline of the pinion shaft or the clutch inner member, and wherein the total surface area of the radially contacting portions is larger than that of the radially non-contacting portions.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

Figure 1:
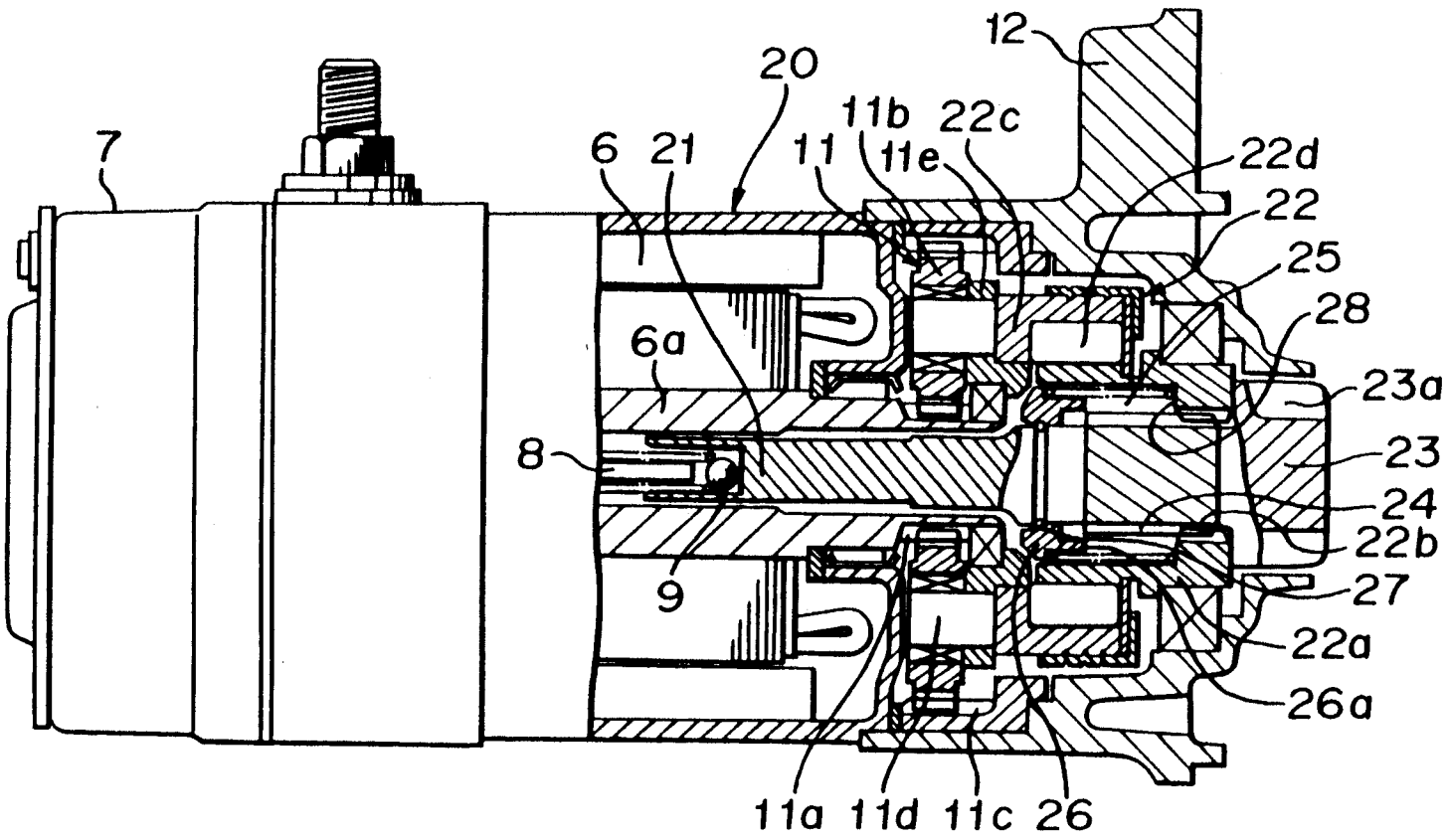
FIG. 1 is a longitudinal cross-sectional view partly broken of an embodiment of the coaxial type starter device.

Referring to the drawings wherein the same reference numerals designate the same or corresponding parts, there is shown in FIG. 1 an embodiment of the coaxial type starter device 20 having a pinion moving means and a load bearing means of the present invention.

In the coaxial type starter device as shown in FIG. 1, a sun gear 11*a* is formed at the outer circumference of the front end of the armature rotary shaft 6*a*. A plurality of planet gears 11*b* are arranged around the sun gear 11*a* so as to be meshed therewith. The planet gears 11*b* are also meshed with an internal gear wheel 11*c* fitted to the inner circumferential surface of a bracket 12, and are supported by a carrier 11*e* by respective pins 11*d*. The sun gear 11*a*, the planet gears 11*b*, the internal gear wheel 11*c*, the pins 11*d* and the carrier 11*e* constitute a planet gear type speed reducing device 11 to reduce the revolution speed of the armature rotary shaft 6*a*.

An overrunning clutch device 22 is fitted to a pinion shaft 21, and a clutch outer member 22*c* is fitted to the outer circumference of the front end of the carrier 11*e* which has a cylindrical shape. The clutch outer member 22*c* and the cylindrical portion at the front end of the carrier 11*e* are fitted to each other so that they cause a slip to thereby reduce a shock when the shock is produced in the overrunning clutch device 22.

The pinion 23 to be engaged with the ring gear of the engine is formed integrally with the pinion shaft 21. With the one-piece structure of the pinion 23 and the pinion shaft 21, the number of teeth of the pinion can be reduced without paying attention to the wall thickness of the bottom portion of the teeth 23*a* of the pinion 23 or the strength of the pinion shaft 21, and accordingly, the gear ratio of the pinion 23 to the ring gear can be increased.

However, the one-piece structure of the pinion 23 and the pinion shaft 21 has the problems as follows. Since the front end portion of the pinion shaft 21 is thick because the pinion 23 is formed, it is only possible that the pinion shaft 21 is assembled with the overrunning clutch device 22 from the front side, i.e., from the side of the ring gear of the engine. Accordingly, it is difficult to use a construction as in the conventional coaxial type starter device that the movement of the pinion shaft 21 is hindered by contacting an end portion of the helical spline formed at the intermediate portion of the pinion shaft 21 with a shoulder portion of the clutch inner member 22*a*. In order to eliminate such difficulty, there is a proposal that a stopper is provided at the rotary output shaft. However, the stopper requires a space for inclusive use and accordingly, it is difficult to reduce the length of the coaxial type starter device even though the size of the d.c. motor is reduced.

In view of the disadvantage of the conventional coaxial type starter device, the coaxial type starter device of the present invention is constructed as follows. A space 25 is formed at the inner diameter portion of the rear end of the clutch inner member 22*a* over the length of $\frac{2}{3}$ of the entire length in the axial direction of the clutch inner member 22*a* so that the outer diameter of the space 25 is greater than the outer diameter of the helical spline 24 formed at the outer circumference of the pinion shaft 21. On the other hand, a helical spline 22*b* is formed at the inner circumference of the front end portion of the clutch inner member 22*a* so that the helical spline 22*b* is to be meshed with the helical spline 24 of the pinion shaft 21. With such structure, the revolution of the armature rotary shaft 6*a* is transmitted to the clutch outer member 22*c* of the overrunning clutch device 22 through the planet gear type speed reducing device 11, and then, is transmitted from the roller 22*d* through the clutch inner member 22*a* and the helical spline 24 to the pinion shaft 21. A ring-shaped stopper 26 is arranged at the rear side of the space 25 formed at the inner circumferential portion of the clutch inner member 22*a*. The stopper 26 is fixed to the pinion shaft 21 by means of a ring 27. Accordingly, the stopper 26 moves in the space 25 along with the pinion shaft 21 when the pinion shaft 21 is moved forwardly by a pushing force provided by the pushing rod 8. When the pinion 23 formed in the pinion shaft 21 reaches the position where it is meshed with the ring gear of the engine, the front end 26*a* of the stopper 26 comes into contact with the enlarged diameter portion formed in the inner circumferential portion of the clutch inner member 22*a* to form the space, namely, the shoulder portion contiguous to a forming portion for the helical spline 22*b*.

Figure 2:
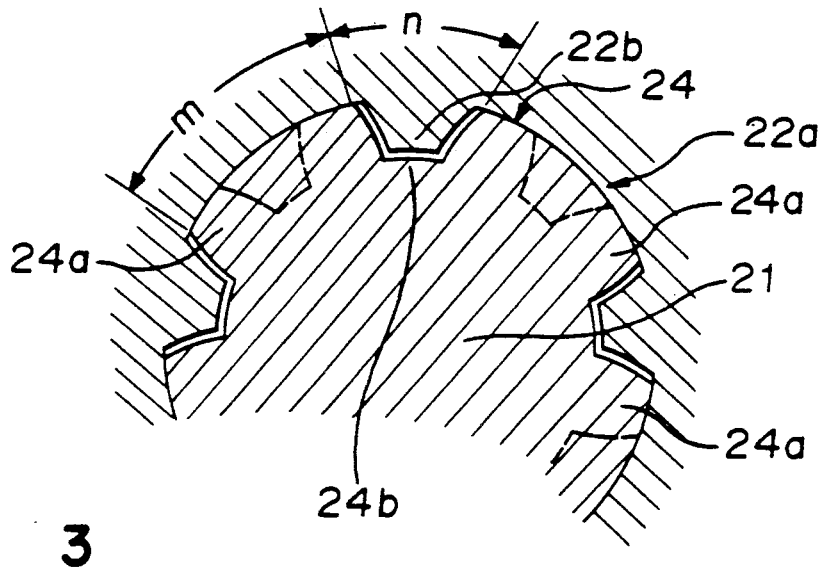
FIG. 2 is a cross-sectional view partly omitted of the coaxial type starter device shown in FIG. 1 wherein the helical splines of a pinion shaft and a clutch inner member are shown in detail.
Figure 5:
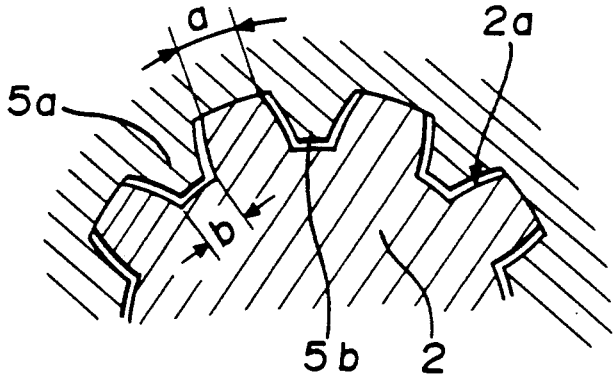
FIGURE 5 PRIOR ART
FIG. 5 is a cross-sectional view partly omitted showing the helical spline of the pinion shaft engaging with the helical spline of the clutch inner member in the conventional coaxial type starter device.
Figure 4:
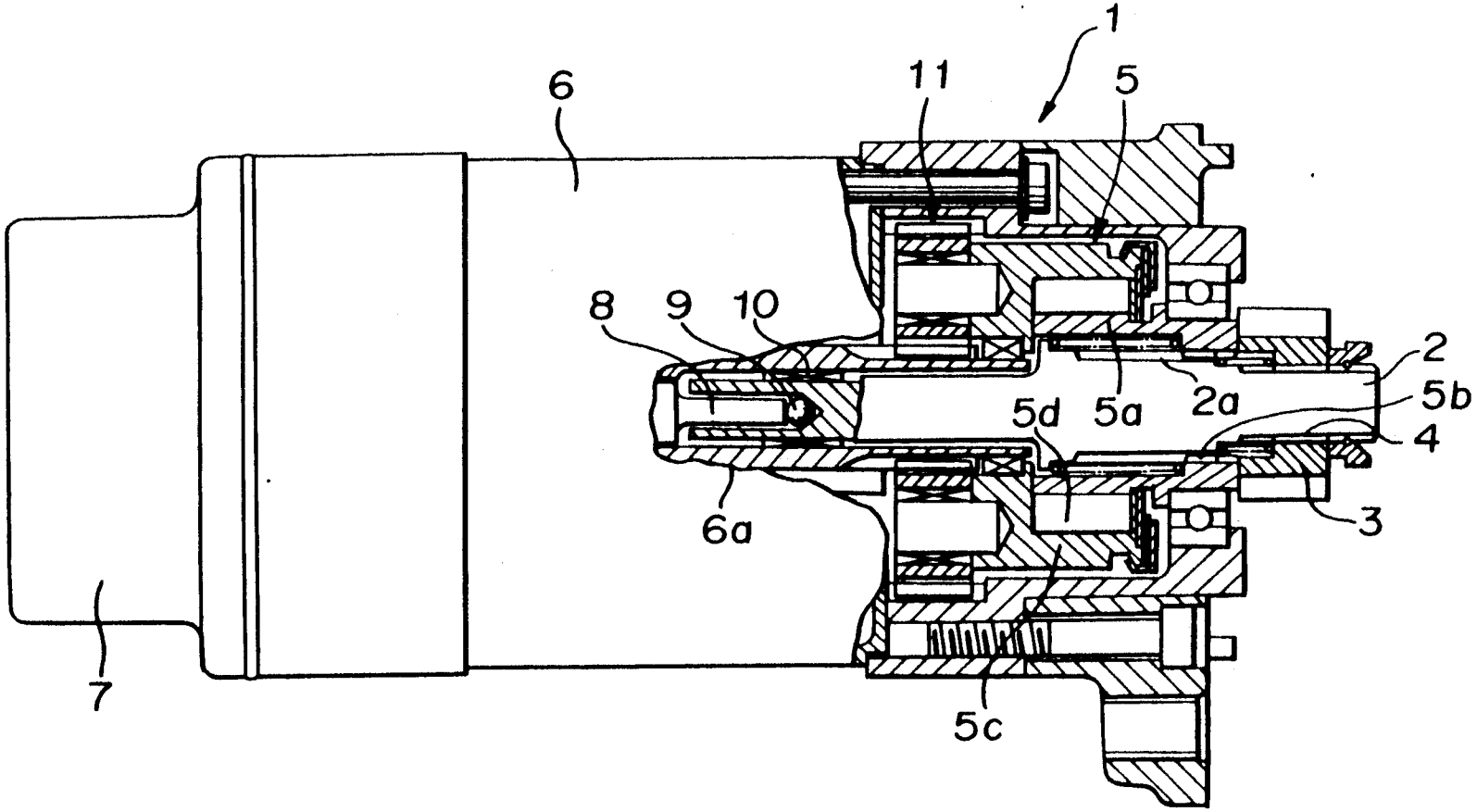
FIGURE 4 PRIOR ART
FIG. 4 is a longitudinal cross-sectional view of a conventional coaxial type starter device.

As shown in FIG. 2, the width m of the outer surfaces of the teeth 24*a* of the helical spline 24 formed at the pinion shaft 21 is formed greater than the width n of the grooves 24*b* of the helical spline. The outer surfaces of the teeth 24*a* are in contact with the bottom surfaces of the grooves of the helical spline 22*b* formed in the clutch inner member 22*a*. In comparing with a conventional helical spline wherein the width a of the upper surfaces of the teeth are substantially equal to the width b of the grooves as shown in FIG. 5, the helical spline 24 of the pinion shaft 21 is so formed that the width m of the teeth 24*a* of the helical spline 24 is as large as to include two spiral tooth lines in the conventional helical spline. The construction as shown in FIG. 2 allows the same manufacturing process as the conventional one or the helical spline provided that the grooves are formed alternately. Therefore, the manufacturing process can be simple.

In the present invention, there are provided the radially contacting portions between the outer surfaces of the teeth 24*a* of the helical spline 24 wherein the width of the outer surface is greater than the width of the bottom surfaces of the grooves of the helical spline 22*b* of the clutch inner member 22*a*. A radial load applied to the pinion shaft 21 is born by the radially contacting portions. On the other hand, there are slight air gaps between the bottom surfaces of the grooves of the helical spline 24 and the upper surfaces of the teeth of the helical spline 22*b*, whereby radially non-contacting portions are formed. Accordingly, the total surface area of the radially contacting portions which bear the load of the pinion shaft 21 by the clutch inner member 22*a*, is far greater than the total surface area of the radially non-contacting portions, whereby a surface pressure at the pressure receiving portions is small to thereby eliminate a fritting phenomenon.

In the coaxial type starter device 20 as shown in FIG. 1, grease is filled in the space 25 so that the grease is applied to radially contacting portions in the movement of the pinion shaft 21, which prevents a shortage of the grease.

Figure 3:
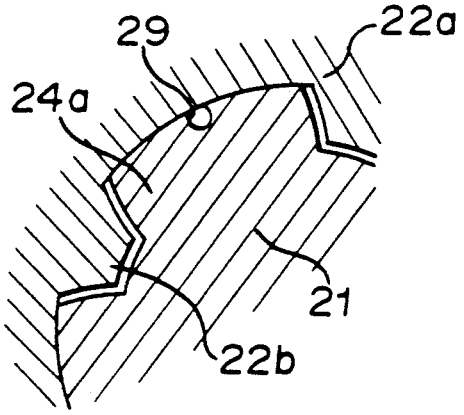
FIG. 3 is a cross-sectional view partly omitted of another embodiment of the coaxial type starter device wherein the helical splines of the pinion shaft and the clutch inner member are shown in detail.

A grease retaining groove 29 may be formed in the outer surface of a tooth 24*a* of the helical spline 24 of the pinion shaft 21 as shown in FIG. 3.

In the above-mentioned embodiment, the radially contacting portions are formed between the outer surfaces of the teeth 24*a* of the helical spline 24 of the pinion shaft 21 and the bottom surfaces of the grooves of the helical spline 22*b* of the clutch inner member 22*a*. However, the bottom surfaces of the grooves of the helical spline 24 of the pinion shaft 21, may be in contact with the outer surfaces of the teeth of the helical spline 22*b* of the clutch inner member 22*a*. In this case, however, the width of the bottom surfaces of the grooves in the helical spline 24 of the pinion shaft has to be greater than the width of the outer surfaces of the teeth of the helical spline 24.

In the above-mentioned spline structure, the helical spline may have the teeth formed at uneven pitches. Further, the present invention can be applied to a starter device of a type other than a coaxial type even though the present invention is particularly effective with the coaxial type starter device.

Thus, in accordance with the present invention, the total surface area of the radially contacting portions between the helical splines of the pinion shaft and the clutch inner member is far greater than the total surface area of the radially non-contacting portions. Accordingly, a surface pressure to the radially contacting portions is small, whereby there is no danger of the occurrence of fritting and of a shortage of grease. Accordingly, the wearing of the helical splines of the pinion shaft and the clutch inner member can be minimized, and a smooth movement of the pinion shaft can be obtained for a long period.

Obviously, numerous modifications and variations of the present invention are possible in light of the above teachings. It is therefore to be understood that within the scope of the appended claims, the invention may be practiced otherwise than as specifically described herein.

What is claimed is:

1. A coaxial type starter device which comprises an overrunning clutch device having a clutch inner member and a pinion shaft with a pinion at an end, said pinion shaft being inserted in said clutch inner member so as to be engageable therewith by means of helical splines formed at said pinion shaft and said clutch inner member so that a torque is transmitted from said clutch inner member to said pinion shaft and a radial load by said pinion shaft is borne by the helical spline of said clutch inner member, wherein the helical splines of said clutch inner member and said pinion shaft have radially contacting portions wherein either the outer surfaces of the teeth of the helical spline of said clutch inner member or the bottom surfaces of the teeth of said pinion shaft are in slide-contact with the corresponding parts of the helical spline of said pinion shaft or said clutch inner member, and have radially non-contacting portions wherein the other portions of the helical spline of said clutch inner member or said pinion shaft face, with gaps, the corresponding parts of the helical spline of said pinion shaft or said clutch inner member, and wherein the total surface area of said radially contacting portions is larger than that of said radially non-contacting portions.

2. The coaxial type starter device according to claim 1, wherein the width of each tooth of the helical spline of said pinion shaft is substantially greater than the width of each corresponding groove of the helical spline of said pinion shaft.

3. The coaxial type starter device according to claim 1, a grease retaining groove is formed in the helical spline in the radially contacting portions.

* * * * *